United States Patent [19]

Halford

[11] 4,161,279

[45] Jul. 17, 1979

[54] CURVED TRACK SECTION FOR TOY VEHICLE

[75] Inventor: Wayne R. Halford, Manhattan Beach, Calif.

[73] Assignee: Mattel, Inc., Hawthorne, Calif.

[21] Appl. No.: 863,473

[22] Filed: Dec. 22, 1977

[51] Int. Cl.[2] ..... A63H 18/02

[52] U.S. Cl. ..... 238/10 F; 46/1 K; 104/60; 104/147 A

[58] Field of Search ..... 238/10 R, 10 A, 10 B, 238/10 C, 10 E, 10 F; 104/53, 54, 60, 147 A, DIG. 1; 273/86 R, 86 B; 46/1 K, 202, 206, 257, 258, 259, 260

[56] References Cited

U.S. PATENT DOCUMENTS

| | | | |
|---|---|---|---|
| 2,636,114 | 4/1953 | Fields | 104/60 X |
| 3,205,833 | 9/1965 | Fitzpatrick | 104/60 |
| 3,206,122 | 9/1965 | Frisbie et al. | 238/10 F |
| 3,290,498 | 12/1966 | Lahr | 238/10 F X |
| 3,291,392 | 12/1966 | Cramer | 238/10 F |
| 3,316,401 | 4/1967 | Cramer | 238/10 F X |
| 3,377,958 | 4/1968 | Bax et al. | 238/10 F X |
| 3,402,503 | 9/1968 | Glass et al. | 238/10 F X |
| 3,445,063 | 5/1969 | Ferentinos | 238/10 F |
| 3,584,410 | 6/1971 | Lalonde | 273/86 B X |
| 3,630,524 | 12/1971 | Cooper et al. | 273/86 R |
| 3,680,488 | 8/1972 | Donlon | 104/130 |
| 3,707,804 | 1/1973 | Cook | 238/10 E X |
| 3,858,875 | 1/1975 | Nemeth et al. | 104/54 X |
| 3,860,237 | 1/1975 | Cooper et al. | 273/86 R |

*Primary Examiner*—Randolph A. Reese

*Attorney, Agent, or Firm*—John G. Mesaros; Max E. Shirk; Ronald M. Goldman

[57] ABSTRACT

A curved track section for self-propelled toy vehicles, the track having a width sufficient to accommodate two toy vehicles side by side. A portion of the track is provided with a lane divider with the entrance end of the track being provided with an abutment portion extending in the direction of travel of the vehicles from a position adjacent the outer periphery to a position generally intermediate the inside and outside of the track, the abutment having a progressively increasing height and width in the direction of travel the vehicle, the lane selection of the vehicle being determined by the speed or angle of entry into the entrance end of the track section.

5 Claims, 8 Drawing Figures

CURVED TRACK SECTION FOR TOY VEHICLE

BACKGROUND OF THE INVENTION

The background of the invention will be discussed in two parts:

FIELD OF THE INVENTION

This invention relates to trackways for toy vehicles and more particularly to a curved track section having a lane selection feature.

DESCRIPTION OF THE PRIOR ART

Self-propelled motor operated toy vehicles utilizing rechargeable batteries as a source of power have become increasingly popular, such toy vehicles usually being of die cast constuction and being adapted for traversing a track section or trackway, usually of a closed loop or continuous loop configuration. Such trackways often times employ figure 8's, chicanes, and lane-change features when the trackways are designed to accommodate two toy vehicles side by side.

In order to simulate actual race situations, such vehicles are often times geared for speed with the trackways being configured to simulate race courses. Once such toy vehicle toy racing game is shown in U.S. Pat. No. 3,860,237 to Cooper, et al, issued on Jan. 14, 1975, the trackway employing steeply banked curves and straight horizontal flat track sections with the width of the track being able to accommodate two vehicles side by side. The trackway is usually made in sections which interlock to enable the track configuration to be re-arranged. In this particular patent, a vehicle diverter track section is employed at the exit end of a curve.

Lane change features on a controlled or random basis are often times used to enhance the amusement of the value of the racing game. Such a feature is more often found in the "slot car" type race game such as U.S. Pat. Nos. 3,377,958; 3,316,401; 3,205,833; and 3,630,524. Other racing tracks for toy vehicles are shown in U.S. Pat. Nos. 2,636,114; 3,206,122; 3,402,503; and 3,584,410.

Of the above referenced patents, U.S. Pat. No. 3,377,958 to Bax, et al discloses a slot car race track wherein deflection elements are positioned in the trackway slot for controlling the switching operation in response to the speed of travel of the vehicle through the switch point. For this purpose, a movable deflection element is positioned in the slot with the momentum of the vehicle determining the amount of deflection and the course of travel of the vehicle.

Such prior art lane change devices require movable parts, are generally employed in conjunction with toy vehicles having a depending guide pin travelling in a slot within a trackway, or, in the case of unguided self-propelled toy vehicles, such lane change devices have been limited in amusement value.

Accordingly, it is an object of this invention to provide a new and improved curved track section for a toy vehicle.

It is another object of this invention to provide a new and improved curved track section having an entrance end which selects the lane in which the vehicle travels according to the angle or speed of entry of the toy vehicle into the entrance end.

SUMMARY OF THE INVENTION

The foregoing and other objects of the invention are accomplished by providing a curved track section having a width sufficient to accommodate two toy vehicles side by side, the track section having an entrance end and an exit end. The entrance end is provided with an abutment commencing adjacent the outer wall thereof and following a curve in the direction of travel of the vehicle to a point intermediate opposing walls, the track section having lane dividers for the balance thereof. The abutment increases in height and width to the given point to thereby permit a toy vehicle entering at a high rate of speed to crossover the abutment into the "high" lane of the banked curve. Alternately a vehicle entering the curve at an angle from the "low" side of the curve towards the "high" side of the curve can likewise enter the high lane. Conversely vehicles entering the curve with a low speed or reverse angle will enter the "low" lane.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
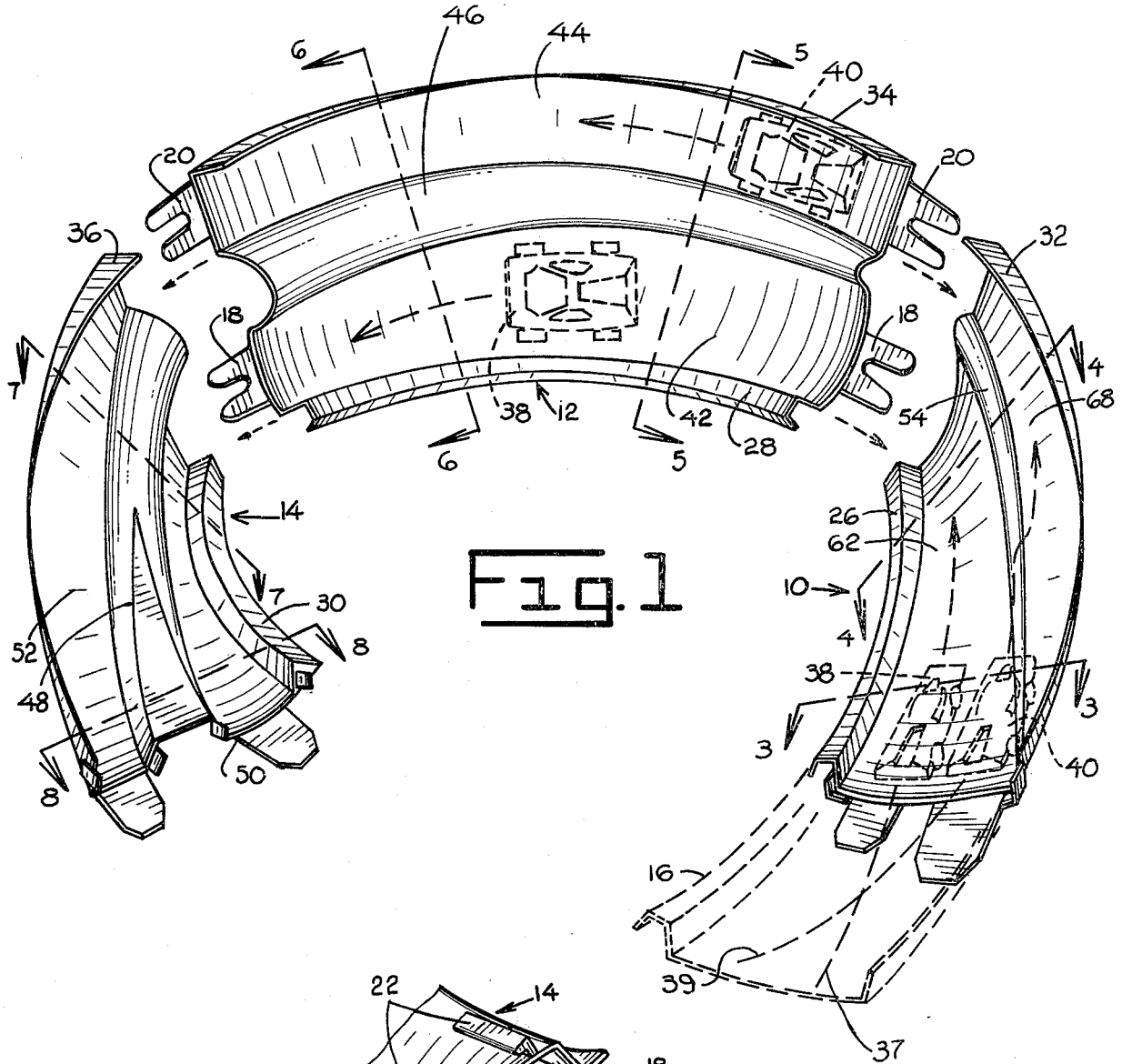
FIG. 1 is a perspective view, partially exploded, of the curved track section according to the inventions.

Referring now to the drawings and particularly to FIG. 1, there is shown a curved trackway formed of three sections generally designated 10, 12 and 14, the sections being adapted for interlocking to provide a curved track section adapted to be fitted with other straight or curved track sections such as track section 16 (only partially shown).

Figure 2:
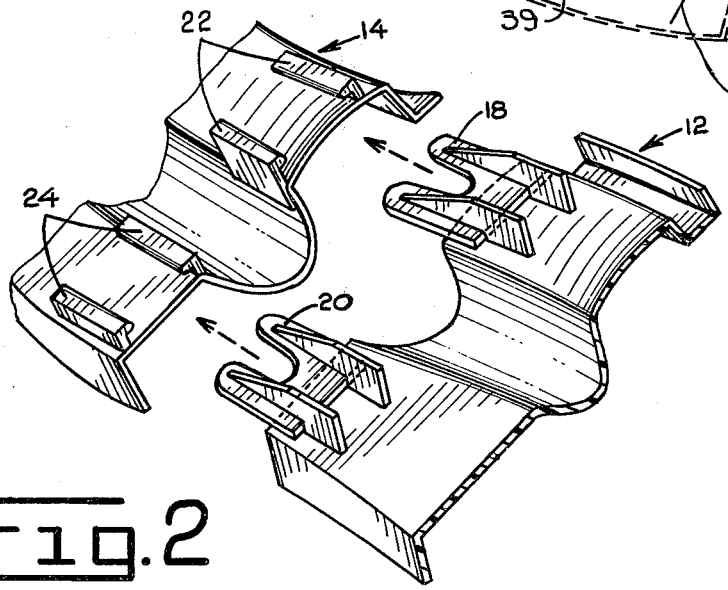
FIG. 2 is an inverted perspective view, partially broken away of adjacent sections illustrating the connection thereof.

The interlocking means is shown in FIG. 2 wherein track sections 12 and 14 have been inverted to illustrate the undersurface thereof, track section 12 having integrally formed on the undersurface thereof a pair of planar tongue members 18 and 20, each of which is split or bifurcated lengthwise to provide a measure of resilience to permit deflection of the ends thereof toward each other during assembly. The tongues 18 and 20 are adapted for insertion within pairs of opposing aligned lug pairs generally designated 22 and 24. Each lug of the lug pairs is of a generally L-shaped cross-section with the free ends thereof inwardly directed toward each other and integrally formed on the undersurface of track section 14 to thereby permit the tongues 18 and 20 to be inserted into the lug pairs 22 and 24 respectfully in tight fitting frictional engagement to form the trackway.

Referring again to FIG. 1, with the track sections 10, 12 and 14 interconnected, the inner radius thereof is provided with a curb or shoulder means including curb section 26 on entrance track section 10, curb section 28 on intermediate track section 12, and curb section 30 on exit track section 14. Correspondingly, the outer periphery of each of the track sections are provided with wall sections 32, 34 and 36 respectfully. The trackway between the curb portion 26 and the wall portion 32 defines a width sufficient for the passage of two vehicles thereon side by side, two of such vehicles being shown in dotted lines and designated 38 and 40 respectively on entrance track section 10. The two vehicles 38 and 40 are shown in dotted lines on intermediate section 12, the toy vehicle 38 occupying a first or "low" or inside lane 42 while the toy vehicle 40 is shown occupying a second or "high" or outside lane 44, the lanes being divided by a lane divider portion 46 which is integrally formed within the trackway. Each of the track sections is a unitary molded assembly including, as in the case of intermediate track section 12, the shoulder portion 28, the inside lane 42, the lane divider 46, the outside lane 44 and the wall 34 along with of course the interlocking tongues 18 and 20.

The lane divider 46 is configured to mate up with a corresponding lane divider 48 form generally centrally with respect to the radial path of exit section 14 which is correspondingly provided with an inside lane 50 and an outside lane 52. In end view the lane divider 46 is a generally inverted U-shaped cross section which increases in width and height from the entrance end of the intermediate track section 12 to the exit end thereof with the lane divider 48 of exit section 14 being configured to continue the inverted U-shaped configuration until the exit end thereof where the upper portion is somewhat flattened to conform to the contour of an adjacent track section (not shown).

With reference to the entrance track section 10, a lane selector abutment is provided within the trackway, the abutment 54 being of an inverted generally U-shaped cross-sectional configuration commencing almost planar with the trackway of the entrance track section 10, the abutment 54 then progressively increasing in height and width relative to the plane of the trackway in the direction of travel of the vehicles 38 and 40 with the beginning of abutment 54 adjacent the entrance end of track section 10 being positioned adjacent the outer wall 32 and then directed in the path of travel of toy vehicles 38 and 40 to a point generally intermediate wall 32 and curb 26 of track section 10 to abut against the beginning of lane divider 46 of intermediate track section 12.

Figure 3:
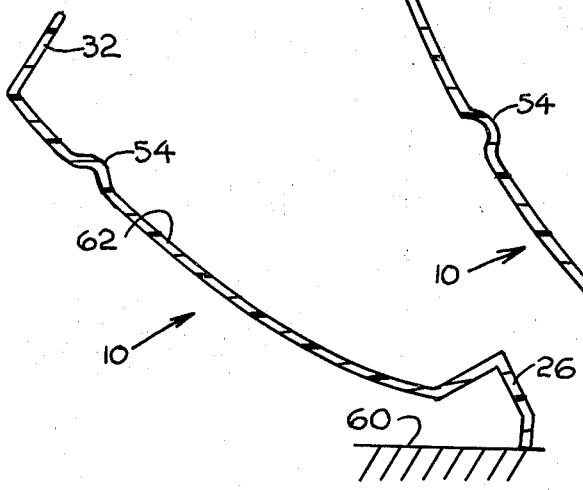
FIG. 3 is a cross-sectional view of the curved track section taken generally along line 3—3 of FIG. 1.
Figure 4:
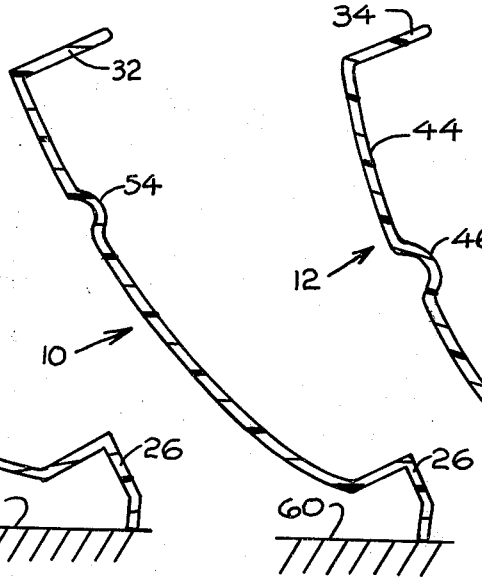
FIG. 4 is a cross-sectional view of the curved track section of FIG. 1 taken generally along line 4—4 thereof.

With reference to FIGS. 3–8, the banked angle of different portions of the curved track are illustrated with reference to a surface 60 on which the track is positioned, the surface 60 being for example a table or a floor or the like. FIG. 3 illustrates in cross-section a point adjacent the entrance end of entrance track section 10 wherein the angular orientation of the trackway 62 relative to the surface 60 is at a fairly low angle with the abutment 54 being in proximity to the wall 32 of track section 10. Adjacent the exit end of the track section 10, as illustrated in FIG. 4, the angle of the trackway 62 relative to the surface 60 increases and the positioning of the abutment 54 relative to the outer wall 32 is radially inward.

Figure 5:
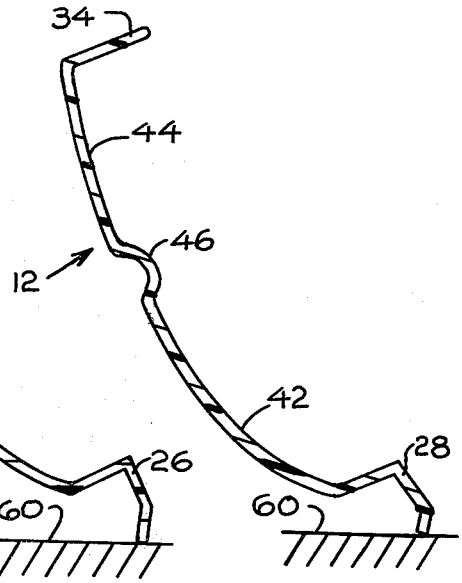
FIG. 5 is a cross-sectional view of the curved track section of FIG. 1 taken generally along line 5—5 thereof.

In FIG. 5, at a point adjacent the entrance end of the intermediate track section 12, the angle of the outside and inside lanes 44 and 42 respectively increases relative to the surface 60 with the lane divider 46 being generally intermediate wall 34 and curb 28 of track section 12.

Figure 6:
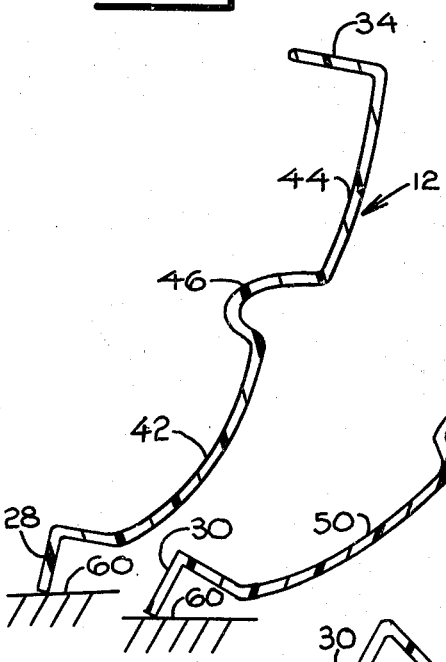
FIG. 6 is a cross-sectional view of the curved track section of FIG. 1 taken generally along line 6—6 thereof.
Figure 7:
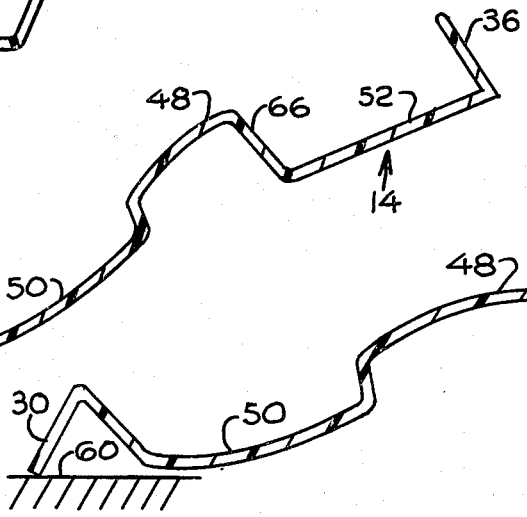
FIG. 7 is a cross-sectional view of the curved track section of FIG. 1 taken generally along line 7—7 thereof.
Figure 8:
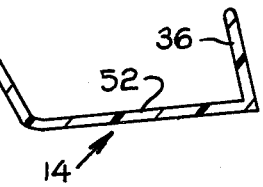
FIG. 8 is a cross-sectional view of the curved track section of FIG. 1 taken generally along line 8—8 thereof.

FIGS. 6, 7 and 8 are viewed in the direction of travel of the vehicle and as can be seen in FIG. 6, the angle defined by the trackway of intermediate track section 12 adjacent the exit end thereof is approximately the same as the angular orientation of the trackway relative to the surface 60 shown in FIG. 5. However, track section 12 is configured to provide an offset between the outside lane 44 and the inside lane 42 with the surface of lane divider 46 adjacent the outside lane approaching horizontal to assist in maintaining a toy vehicle within the outside lane at this point, since the vehicle will be losing some speed as it goes through the curve.

As the vehicle enters the exit track section 14, as depicted in FIG. 7, the lane divider 48 is configured somewhat differently to provide a generally straight wall portion 66 adjacent outside lane 52 to assist in retaining a toy vehicle on the outside lane 52. It is to be noted that the angular orientation or bank relative to the surface 60 is decreasing and decreases further until as shown in FIG. 8 the plane of the trackway approaches horizontal.

As viewed in plan view generally in FIG. 1, the combined curved trackway formed by the track sections 10, 12 and 14 is banked at an angle which increases from the inside of the plan curve to the outside thereof adjacent the wall defined by wall sections 32, 34 and 36, the width of each track section being generally uniform and sufficient for passage of two toy vehicles 38 and 40 side by side. The trackway form by the interconnected sections 10, 12 and 14, as viewed in cross-section and as described in reference to FIGS. 3–8 has the plane of the lanes thereof increasing relative to a horizontal surface 60 from the exit end to a maximum at a point intermediate the entrance end of track section 10 and the exit end of track section 14, this angle then decreasing to the end of track section 14.

In operation, referring again to FIG. 1, depending on the speed and/or angle of entry of the toy vehicles 38 and 40, the vehicle will select an inside lane or outside lane. For example, with reference to vehicle 38, as it passes through track section 16 to enter track section 10 along the dotted line path designated 37, it will be entering from the outer end of track section 16 indicating a high angle of entry or a low speed at which point the vehicle 38 will traverse trackway 62 in the direction of the arrow thereon in advance of vehicle 38, this trackway 62 being adjacent the inner radius or curb 26 of track section 10.

With reference to toy vehicle 40, if it traverses track section 16 along the path designated by dotted line 39, the vehicle 40 will be entering the entrance track section 10 of the curve trackway from the inside to the outside thereof generally indicating an inside to outside angle of entry or a high speed, at which point the momentum of the toy vehicle 40 will enable the wheels thereof to pass over the abutment 54 to pass in to the exit end of section 10 into the lane designated 68 which is the outside lane for further traversal of the outside lane 44 of intermediate track section 12 through outside lane 52 of the exit track section 14. During this travel, the configuration of the lane dividers 46 and 48 will enable the toy vehicle 40 to remain in the outside lane notwithstanding a slight loss of speed.

With the abutment 54 of the entrance track section 10 being configured to start from a point adjacent the outside wall 32 thereof and being directed radially inwardly as the abutment 54 commences in the direction of the path of travel the toy vehicle, the diverting of a toy vehicle into the lane 68 becomes increasingly difficult as it traverses the track section 10 permitting selection of the outside lane 68 only if the angle of attack of the vehicle relative to the abutment 54 is sufficient, and the speed or momentum of the vehicle is sufficient.

Consequently, the curved trackway hereinabove described provides amusement value for a toy vehicle racing situation wherein the speed and angle of entry of the toy vehicle determines the lane traversed through the curved trackway. The curved trackway is formed of three sections, each of which is a unitary molded configuration, and when interconnected the abutment 54 along with lane dividers 46 and 48 create a smoothly contoured configuration for lane selection and division. While there has been shown and described a preferred embodiment, it is to be understood that various other modifications may be made within the spirit and scope of the invention.

What is claimed is:

1. In a toy vehicle track configured for traversal thereover of at least one self-propelled toy vehicle, the combination comprising:

a trackway being curved as seen in plan view and banked at an angle which increases from the inside of said plan curve to the outside thereof, said trackway having an entrance end and an exit end and having a track width sufficient for two vehicles side by side;

wall means on the outside of said trackway and shoulder means on the inside of said trackway for maintaining said vehicles thereon;

first means within at least a portion of said trackway for dividing said trackway into first and second lanes; and nonmovable abutment means integrally formed within said trackway adjacent said entrance end from a point adjacent said wall means along a curved path to a position generally intermediate said wall means and said shoulder means for selectively permitting said vehicle to enter one of said first and second lanes in response to the speed of entry or the angle of entry of the toy vehicle at said entrance end of said trackway, said abutment means having at least a portion thereof configured for passage thereover by a toy vehicle having sufficient momentum.

2. The combination according to claim 1 wherein said abutment means at said point is generally co-extensive in height with the track surface of said trackway, said abutment means having a progressively increasing height and width in the direction of the path of travel of the vehicle towards a generally intermediate position.

3. The combination according to claim 2 wherein said first means is an integrally formed inverted generally U-shaped lane divider, said abutment means and said lane divider forming a generally continuous surface as seen in plan view.

4. The combination according to claim 3 wherein said trackway is formed of a plurality of interlocking track sections.

5. The combination according to claim 4 wherein said second lane is adjacent said wall means and lies in a plane off set outwardly from said first lane adjacent the exit end of said trackway.

* * * * *